United States Patent [19]

Tam

[11] Patent Number: 4,536,457

[45] Date of Patent: Aug. 20, 1985

[54] MIGRATION IMAGING PROCESS

[75] Inventor: Man C. Tam, Mississauga, Canada

[73] Assignee: Xerox Corporation, Stamford, Conn.

[21] Appl. No.: 568,001

[22] Filed: Jan. 3, 1984

[51] Int. Cl.[3] ..... G03G 13/22

[52] U.S. Cl. ..... 430/41; 430/67; 430/96

[58] Field of Search ..... 430/41, 96

[56] References Cited

U.S. PATENT DOCUMENTS

| | | | |
|---|---|---|---|
| 3,753,705 | 8/1973 | Goffe | 430/41 |
| 3,954,464 | 5/1976 | Karam et al. | 96/1.5 |
| 4,101,321 | 7/1978 | Levy et al. | 96/1.5 |

*Primary Examiner*—Roland E. Martin

*Attorney, Agent, or Firm*—Peter H. Kondo

[57] ABSTRACT

An imaging method comprising providing a migration imaging member comprising a substrate and an electrically insulating softenable layer on the substrate, the softenable layer comprising migration marking material located at least at or near the surface of the softenable layer spaced from the substrate and a charge transport material in the softenable layer, electrostatically charging the member, exposing the member to activating radiation in an imagewise pattern, decreasing the resistance to migration of marking material in the softenable layer sufficiently to allow slight migration in depth of marking material towards the substrate in image configuration, and further decreasing the resistance to migration of marking material in the softenable layer sufficiently to allow nonmigrated marking material to agglomerate.

15 Claims, 7 Drawing Figures

MIGRATION IMAGING PROCESS

BACKGROUND OF THE INVENTION

This invention relates generally to migration imaging, and more specifically to an improved migration imaging process.

Migration imaging systems capable of producing high quality images of high optical density, continuous tone and high resolution, have been developed. Such migration imaging systems are disclosed, for example, U.S. Pat. No. 3,909,262 which issued Sept. 30, 1975 and U.S. Pat. No. 3,975,195 which issued Aug. 17, 1976, the disclosures of both being incorporated herein in their entirety. In a typical embodiment of migration imaging systems, an imaging member comprising a substrate, a layer of softenable material, and photosensitive marking material is imaged by first forming a latent image by electrically charging the member and exposing the charged member to a pattern of activating electromagnetic radiation such as light. Where the photosensitive marking material was originally in the form of a fracturable layer contiguous the upper surface of the softenable layer, the marking particles in the exposed area of the member migrate in depth toward the substrate when the member is developed by softening the softenable layer.

The expression "softenable" as used herein in intended to mean any material which can be rendered more permeable thereby enabling particles to migrate through its bulk. Conventionally, changing the permeability of such material or reducing its resistance to migration of migration marking material is accomplished by dissolving, swelling, melting or softening, by techniques, for example, such as contacting with heat, vapors, partial solvents, solvent vapors, solvents and combinations thereof, or by otherwise reducing the viscosity of the softenable material by any suitable means.

The expression "fracturable" layer or material as used herein, means any layer or material which is capable of breaking up during development, thereby permitting portions of said layer to migrate toward the substrate or to be otherwise removed. The fracturable layer is preferably particulate in the various embodiments of the migration imaging members of the present invention. Such fracturable layers of marking material are typically contiguous to the surface of the softenable layer spaced apart from the substrate, and such fracturable layers may be substantially or wholly embedded in the softenable layer in various embodiments of the imaging members of the inventive system.

The expression "contiguous" as used herein is intended to mean in actual contact; touching; also, near, though not in contact; and adjoining, and is intended to generically describe the relationship of the fracturable layer of marking material in the softenable layer, vis-a-vis, the surface of the softenable layer spaced apart from the substrate.

The expression "sign retained" as used herein is intended to mean that the dark (higher optical density) and light (lower optical density) areas of the image formed on the migration imaging member correspond to the dark and light areas of the image on the original.

The expression "signal reversed" as used herein is intended to mean that the dark areas of the image formed on the migration imaging member correspond to the light areas of the image on the original and the light areas of the image formed on the migration imaging member correspond to the dark areas of the image on the original.

The expression "contrast density" as used herein is intended to mean the difference between maximum optical density ($D_{max}$) and minimum optical density ($D_{min}$) of an image. Optical density is measured for the purpose of this application by diffuse densitometers with a blue Wratten No. 94 filter. The expression "optical density" as used herein is intended to mean "transmission optical density" and is represented by the formula:

$$\log_{10} [I_o/I]$$

where I is the transmitted light intensity and $I_o$ is the incident light intensity. While contrast density is measured by diffuse densitometers in this application, it should be noted that measurement by specular densitometers gives substantially similar results.

There are various other systems for forming such images, where non-photosensitive or inert marking materials are arranged in the aforementioned fracturable layers, or dispersed throughout the softenable layer, as described in the aforementioned patent, which also discloses a variety of methods which may be used to form latent images upon migration imaging members.

Various means for developing the latent images in the novel migration imaging system may be used. These development methods include solvent wash-away, solvent vapor softening, heat softening, and combinations of these methods, as well as any other method which changes the resistance of the softenable material to the migration of particulate marking material through the softenable layer to allow imagewise migration of the particles in depth toward the substrate. In the solvent wash-away or meniscus development method, the migration marking material in the light-struck region migrates toward the substrate through the softenable layer, which is softened and dissolved, and repacks into a more or less monolayer configuration. This region exhibits a maximum optical density which can be as high as the initial optical density of the unprocessed film. On the other hand, the migration marking material in the unexposed region is substantially washed away and this region exhibits a minimum optical density which is essentially the optical density of the substrate alone. Therefore the image-sense of the developed image is sign-reversed, i.e. positive to negative or vice versa. Various methods and materials and combinations thereof have previously been used to fix such unfixed migration images. In the heat, or vapor softening developing modes, the migration marking material in the light-struck region disperses in the depth of the softenable layer after development and this region exhibits $D_{min}$ which is typically in the range of 0.6–0.7. This relatively high $D_{min}$ is a direct consequence of the depthwise dispersion of the otherwise unchanged migration marking material. On the other hand, the migration marking material in the unexposed region does not migrate and substantially remains in the original configuration, i.e. a monolayer. This region tube exhibits maximum optical density ($D_{max}$). Therefore, the image sense of the heat or vapor developed images is sign-retaining, i.e. positive-to-positive or negative-to-negative.

Techniques have been devised to permit sign-reversed imaging with vapor development, but these techniques are generally complex and require critically controlled processing conditions. An example of such techniques can be found in U.S. Pat. No. 3,795,512.

For many imaging applications, such as lithographic intermediate film in the graphic arts industry, it is desirable to produce negative images from a positive original or positive images from a negative original i.e. sign-reversing imaging, preferably with low mininum optical density. Although the meniscus or solvent wash-away development method produces sign-reversed images with low minimum optical density, it involves removal of materials from the migration imaging member, leaving the migration image largely or totally unprotected from abrasion. Although various methods and materials have previously been used to overcoat such unfixed migration images, the post-development overcoating step is impractically costly and inconvenient for the end users. Additionally, disposal of the effluents washed from the migration imaging member during development is very costly. While heat or vapor development methods are preferred because they are rapid, essentially dry and produce no liquid effluents, the image sense of the heat or vapor developed images is sign-retaining and the minimum optical density is quite high. Therefore, there is a continuing need for a simple, inexpensive, and usable imaging member capable of sign-reversing imaging with essentially dry development methods and preferably giving low minimum optical density.

The background portions of an imaged member may sometimes be transparentized by means of an agglomeration and coalescence effect. In this system, an imaging member comprising a softenable layer containing a fracturable layer of electrically photosensitive migration marking material is imaged in one process mode by electrostatically charging the member, exposing the member to an imagewise pattern of activating electromagnetic radiation, and the softenable layer softened by exposure for a few seconds to a solvent vapor thereby causing a selective migration in depth of the migration material in the softenable layer in the areas which were previously exposed to the activating radiation. The vapor developed image is then subjected to a heating step. Since the exposed particles gain a substantial net charge (typically 85–90% of the deposited surface charge) as a result of light exposure, they migrate substantially in depth in the softenable layer towards the substrate when exposed to a solvent vapor, thus causing a drastic reduction in optical density. The optical density in this region is typically in the region of 0.7 to 0.9 after vapor exposure, compared with an initial value of 1.8 to 1.9. In the unexposed region, the surface charge becomes discharged due to vapor exposure. The subsequent heating step causes the unmigrated, uncharged migration material in unexposed areas to agglomerate or flocculate, often accompanied by coalescence of the marking material particles, thereby resulting in a migration image of very low minimum optical density (in the unexposed areas) in the 0.25–0.35 range. Thus the contrast density of the final image is typically in the range of 0.35 to 0.65. Alternatively, the migration image may be formed by heat followed by exposure to solvent vapors and a second heating step which also results in a migration image with very low minimum optical density. In this imaging system as well as in the previously described heat or vapor development techniques, the softenable layer remains substantially intact after development, with the image being self-fixed because the marking material particles are trapped within the softenable layer. Although the minimum optical density ($D_{min}$) of images using such techniques is much reduced, there is generally a concurrent drastic reduction in the maximum optical density ($D_{max}$) (since these areas consist of marking material particles which have migrated substantially in depth) and consequently the contrast density ($D_{max}$-$D_{min}$) is also low. There is also usually a substantial reduction in the resolving power of the film, because of the agglomeration of the marking material particles.

The word "agglomeration" as used herein is defined as the coming together and adhering of previously substantially separate particles, without the loss of identity of the particles.

The word "coalescence" as used herein is defined as the fusing together of such particles into larger units, usually accompanied by a change of shape of the agglomerate towards a shape of lower energy, such as a sphere.

Generally, the softenable layer of migration imaging members is characterized by sensitivity to abrasion and foreign contaminants. Since a fracturable layer is located at or close to the surface of the softenable layer, abrasion can readily remove some of the fracturable layer during either manufacturing or use of the film and adversely affect the final image. Foreign contamination such as finger prints can also cause defects to appear in any final image. Moreover, the softenable layer tends to cause blocking of migration imaging members when multiple members are stacked or when the migration imaging material is wound into rolls for storage or transportation. Blocking is the adhesion of adjacent objects to each other. Blocking usually results in damage to the objects when they are separated.

The sensitivity to abrasion and foreign contaminants can be reduced by forming an overcoating such as the overcoatings described in the aforementioned U.S. Pat. No. 3,909,262. However, because the migration imaging mechanisms for each development method are different and because they depend critically on the electrical properties of the surface of the softenable layer and on the complex interplay of the various electrical processes involving charge injection from the surface, charge transport through the softenable layer, charge capture by the photosensitive particles and charge ejection from the photosensitive particles etc., application of an overcoat to the softenable layer often causes changes in the delicate balance of these processes, and results in degraded photographic characteristics compared with the non-overcoated migration imaging member. Notably, the photographic contrast density is degraded.

In addition, many overcoatings do not prevent blocking when migration imaging members are stacked or wound into rolls. In addition, for applications where migration imaging members are utilized for composing lithographic intermediates wherein imaged migration imaging members are temporarily secured by adhesive tape to a substrate and thereafter reused, very often the migration imaging member is damaged by removal of the adhesive tape and is rendered unsuitable for reuse. This damage generally takes two forms. First, many overcoats do not adhere well to the softenable layer of the migration imaging member and can be separated by flexing or easily separated or removed entirely from the softenable layer upon removal of the adhesive tape, thereby eliminating further abrasion resistance. Secondly, the softenable layer which contains the photoactive particles often separates from the substrate upon removal of the adhesive tape. Therefore, the overcoat should not only adhere well to the softenable layer but should also have abhesive properties to release the adhesive tape to prevent damage to the migration imaging member.

Therefore, there continues to be a need for an improved migration imaging process. Additionally, there is a need for an improved migration imaging process capable of producing sign-reversed images having high contrast density and low $D_{min}$, which exhibit greater resistance to the adverse effects of finger prints, blocking, softenable layer/overcoating layer interface failure, and abrasion, and which can survive adhesive tape tests.

SUMMARY OF THE INVENTION

It is an object of the present invention to provide an improved migration imaging process which overcomes the above-noted disadvantages and satisfies the above noted objectives.

It is another object of the present invention to provide an improved migration imaging process which is an essentially dry process, requires only simple processing steps, has exceptionally wide processing latitude and produces excellent sign-reversed images, having very low $D_{min}$ and of a nearly neutral color.

It is yet another object of the present invention to provide a simple, reliable, substantially dry process for imaging an improved migration imaging member which produces excellent sign-reversed migration images having very low $D_{min}$, high contrast density and high resolution.

It is yet another object of the present invention to provide an improved migration imaging process which provides a migration imaging member which not only possesses tolerance to abrasion, minimizes blocking, is insensitive to fingerprints and possesses good surface release properties, but also produces excellent sign-reversed migration images having very low $D_{min}$, high contrast density and high resolution.

These and other objects of the present invention are accomplished by an improved migration imaging process comprising providing a migration imaging member comprising a substrate and an electrically insulating softenable layer on the substrate, the softenable layer comprising a charge transport material, and migration marking material located at least at or near the surface of the softenable layer spaced from the substrate, electrostatically charging the migration imaging member, exposing the member to activating radiation in an imagewise pattern, decreasing the resistance to migration of marking material in the softenable layer so as to allow slight migration in depth of marking material toward the substrate in image configuration, and further developing the member by further decreasing the resistance to migration of marking material in the softenable layer at least sufficiently to allow nonmigrated marking material to agglomerate and substantially coalesce. Preferably decreasing of the resistance to migration of marking material in the softenable layer so as to allow slight migration in depth of marking material toward the substrate in image configuration is effected by exposing the member to a vapor of a solvent for the softenable layer and further decreasing of the resistance to migration of marking material in the softenable layer at least sufficient to allow nonmigrated marking material to agglomerate and substantially coalesce is effected by heating.

BRIEF DESCRIPTION OF THE DRAWINGS

For a better understanding of the present invention, and further features thereof, reference is made to the following detailed description of various preferred embodiments wherein.

Figure 1:
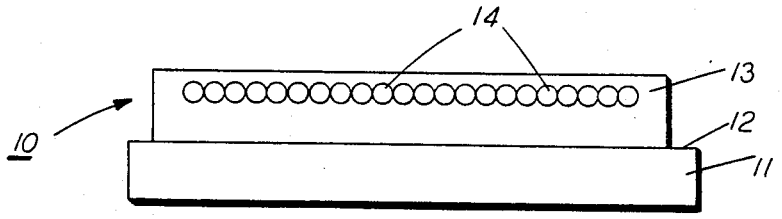
FIG. 1 is a partially schematic, cross-sectional view of a typical layered configuration migration imaging member.

These Figures merely schematically illustrate the invention and are not intended to indicate relative size and dimensions of actual imaging members or components thereof.

DESCRIPTION OF THE PREFERRED EMBODIMENTS

Migration imaging members typically suitable for use in the migration imaging processes described above are illustrated in FIGS. 1 and 2. In the migration imaging member 10 illustrated in FIG. 1, the member comprises substrate 11 having a layer of softenable material 13 coated thereon, the layer of softenable material 13 having a fracturable layer of migration marking material 14 contiguous with the upper surface of softenable layer 13. Particles of marking material 14 appear to be in contact with each other in the Figures due to the physical limitations of such schematic illustrations. The particles of marking material 14 are actually spaced less than a micrometer apart from each other. In the various embodiments, the supporting substrate 11 may be either electrically insulating or electrically conductive. In some embodiments the electrically conductive substrate may comprise a supporting substrate 11 having a conductive coating 12 coated onto the surface of the supporting substrate upon which the softenable layer 13 is also coated. The substrate 11 may be opaque, translucent, or transparent in various embodiments, including embodiments wherein the electrically conductive layer 12 coated thereon may itself be partially or substantially transparent. The fracturable layer of marking material 14 contiguous the upper surface of the softenable layer 13 may be slightly, partially, substantially or entirely embedded in softenable material 13 at the upper surface of the softenable layer.

Figure 2:
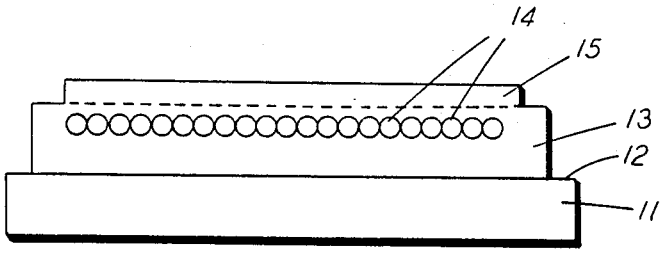
FIG. 2 is a partially schematic, cross-sectional view of an overcoated migration imaging member.

In FIG. 2, a multi-layered overcoated embodiment of the present invention is shown wherein supporting substrate 11 has conductive coating 12 and a layer of softenable material 13 coated thereon. The migration marking material 14 is initially arranged in a fracturable layer contiguous the upper surface of softenable material layer 13. In the embodiment illustrated in FIG. 2, the migration imaging member also includes an advantageous overcoating layer 15 which is coated over the softenable layer 13. In the various embodiments of the novel migration imaging member of this invention, the overcoating layer 15 may comprise an abhesive or release material or may comprise a plurality of layers in which the outer layer comprises an abhesive or release material.

The substrate and the entire migration imaging member which it supports may be in any suitable form including a web, foil, laminate or the like, strip, sheet, coil, cylinder, drum, endless belt, endless moebius strip, circular disc or other shape. The present invention is particularly suitable for use in any of these configurations.

The conductive coating 12 may, like substrate 11, be of any suitable shape. It may be a thin vacuum deposited metal or metal oxide coating, a metal foil, electrically conductive particles dispersed in a binder and the like. Typical metals and metal oxides include aluminum, indium, gold, tin oxide, indium tin oxide, silver, nickel, and the like.

In various modifications of the novel migration imaging members of the present invention, the migration marking material is preferably electrically photosensitive, photoconductive, or of any other suitable combination of materials. Typical migration marking materials are disclosed, for example, in U.S. Pat. No. 3,909,262 which issued Sept. 30, 1975 and U.S. Pat. No. 3,975,195 which issued Aug. 17, 1976, the disclosures of both being incorporated herein in their entirety. Specific examples of migration marking materials include selenium and selenium-tellurium alloys. The migration marking materials should be particulate and closely spaced from each other. The preferred migration marking materials are generally spherical in shape and submicron in size. These spherical migration marking materials are well known in the migration imaging art. Excellent results are achieved with spherical migration marking materials ranging in size from about 0.2 micrometer to about 0.4 micrometer and more preferably from about 0.3 micrometer to about 0.4 micrometer embedded as a sub-surface monolayer in the external surface (surface spaced from the substrate if an overcoating is employed) of the softenable layer. The spheres of the migration marking material are preferably spaced less from each other by a distance of less than about one-half the diameter of the spheres for maximum optical density and to facilitate agglomeration and coalescence of the migration marking material during the heating step. The spheres are also preferably from about 0.01 micrometer to about 0.1 micrometer below the outer surface (surface spaced from the substrate if an overcoating is employed) of the softenable layer. An especially suitable process for depositing the migration marking material in the softenable layer is described in copending U.S. Patent Application Ser. No. 480,642, entitled Multistage Deposition Process, filed Mar. 31, 1983 in the names of P. Soden and P. Vincett, the disclosure of which is incorporated herein in its entirety. For the purposes of the present invention, it is highly preferred that the migration marking material have a sufficiently low melting point that its self-diffusion is rapid at the temperatures used for heat development. The temperatures used for heat development must not exceed the degradation point of the softenable material, the substrate or any other component of the migration imaging member. The word "rapid" is intended to mean that particles of migration marking material which are in contact should coalesce preferably within a few seconds or at most within about a minute.

The softenable material 13 may be any suitable material which may be softened by solvent vapors. In addition, in many embodiments of the migration imaging member, the softenable material 13 is typically substantially electrically insulating and does not chemically react during the migration force applying and developing steps of the present invention. It should be noted that, if conductive layer 12 is not utilized, layer 11 should preferably be substantially electrically conductive for the preferred modes thereof of applying electrical migration forces to the migration layer. Although the softenable layer has been described as coated on a substrate, in some embodiments, the softenable layer may itself have sufficient strength and integrity to be substantially self-supporting and may be brought into contact with a suitable substrate during the imaging process.

Any suitable solvent swellable, softenable material may be utilized in layer 13. Typical swellable, softenable layers include styreneacrylate copolymers, polystyrenes, alkyd substituted polystyrenes, styrene-olefin copolymers, styrene-co-n-hexylmethacrylate, a custom synthesized 80/20 mole percent copolymer of styrene and hexylmethacrylate having an intrinsic viscosity of 0.179 dl/gm; other copolymers of styrene and hexylmethacrylate, styrene-vinyltoluene copolymer, polyalphamethylstyrene, co-polyesters, polyesters, polyurethanes, polycarbonates, co-polycarbonates, mixtures and copolymers thereof. The above group of materials is not intended to be limiting, but merely illustrative of materials suitable for such softenable layers.

Any suitable charge transport material capable of acting as a softenable layer material or which is soluble or dispersible on a molecular scale in the softenable layer material may be utilized in the softenable layer of this invention. The charge transport material is defined as an electrically insulating film-forming binder or a soluble or molecularly dispersable material dissolved or molecularly dispersed in an electrically insulating film-forming binder which is capable of improving the charge injection process (for at least one sign of charge) from the marking material into the softenable layer (preferably prior to, or at least in the early stages of, development by softening of the softenable layer), the improvement being by reference to an electrically-inert insulating softenable layer. The charge transport materials may be hole transport materials and/or electron transport materials, that is they may improve the injection of holes and/or electrons from the marking material into the softenable layer. Where only one polarity of injection is improved, the sign of ionic charge used to initially sensitize the migration marking member to light for the purposes of this invention is most commonly the same as the sign of charge whose injection is improved. The selection of a combination of a specific transport material with a specific marking material should therefore be such that the injection of holes and/or electrons from the marking material into the softenable layer is improved compared to a softenable layer which is free of any transport material. Where the charge transport material is to be dissolved or molecularly dispersed in an insulating film-forming binder, the combination of the charge transport material and the insulating film-forming binder should be such that the charge transport material may be incorporated into the film-forming binder in sufficient concentration levels while still remaining in solution or molecularly dispersed. If desired, the insulating film-forming binder need not be utilized where the charge transport material is a polymeric film-forming material.

Any suitable charge transporting material may be used. Charge transporting materials are well known in the art. Typical charge transporting materials include the following:

Diamine transport molecules of the types described in U.S. Pat. Nos. 4,306,008, 4,304,829, 4,233,384, U.S. Pat. No. 4,115,116, U.S. Pat. No. 4,299,897 and U.S. Pat. No. 4,081,274. Typical diamine transport molecules include N,N'-diphenyl-N,N'-bis(3''-methylphenyl)-(1,1'-biphenyl)-4,4'-diamine, N,N'-diphenyl-N,N'-bis(4-methylphenyl)-(1,1'-biphenyl)-4,4'-diamine, N,N'-diphenyl-N,N'-bis(2-methylphenyl)-(1,1'-biphenyl)-4,4'-diamine, N,N'-diphenyl-N,N'-bis(3-ethylphenyl)-(1,1'-biphenyl)-4,4'-diamine, N,N'-diphenyl-N,N'-bis(4-ethylphenyl)-(1,1'-biphenyl)-4,4'-diamine, N,N'-diphenyl-N,N'-bis(4-n-butylphenyl)-(1,1'-biphenyl)-4,4'-diamine, N,N'-diphenyl-N,N'-bis(3-chlorophenyl)-[1,1'-biphenyl]-4,4'-diamine, N,N'-diphenyl-N,N'-bis(4-chlorophenyl)-[1,1'-biphenyl]-4,4'-diamine, N,N'-diphenyl-N,N'-bis(phenylmethyl)-[1,1'-biphenyl]-4,4'-diamine, N,N,N',N'-tetraphenyl-[2,2'-dimethyl-1,1'-biphenyl]-4,4'-diamine, N,N,N',N'-tetra-(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl-[2,2'-dimethyl-1,1'-biphenyl]-4,4'-diamine, N,N'-diphenyl-N,N'bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and the like.

Pyrazoline transport molecules as disclosed in U.S. Pat. No. 4,315,982, U.S. Pat. No. 4,278,746, and U.S. Pat. No. 3,837,851. Typical pyrazoline transport molecules include 1-[lepidyl-(2)[-3-(p-diethylaminophenyl)-5-(p-diethylaminophenyl)pyrazoline, 1-[quinolyl-(2)]-3-(p-diethylaminophenyl)-5-(p-diethylaminophenyl)-pyrazoline, 1-[pyridyl-(2)]-3-(p-diethylaminostyryl)-5-(p-diethylaminophenyl)pyrazoline, 1-[6-methoxypyridyl-(2)]-3-(p-diethylaminostyryl)-5-(p-diethylaminophenyl)pyrazoline, 1-phenyl-3-[p-dimethylaminostyryl]-5-(p-dimethylaminostyryl)pyrazoline, 1-phenyl-3-[p-diethylaminostyryl]-5-(p-diethylaminostyryl)-pyrazoline, and the like.

Substituted fluorene charge transport molecules as described in U.S. Pat. No. 4,245,021. Typical fluorene charge transport molecules include 9-(4'-dimethylaminobenzylidene)fluorene, 9-(4'-methoxybenzylidene)fluorene, 9-(2',4'-dimethoxybenzylidene)fluorene, 2-nitro-9-benzylidene-fluorene,2-nitro-9-(4'-diethylaminobenzylidene)fluorene and the like.

Oxadiazole transport molecules such as 2,5-bis(4-diethylaminophenyl)-1,3,4-oxadiazole, pyrazoline, imidazole, triazole, and the like. Other typical oxadiazole transport molecules are described, for example, in German Pat. Nos. 1,058,836, 1,060,260 and 1,120,875.

Hydrazone transport molecules such as p-diethylamino benzaldehyde-(diphenyl hydrazone)), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde-(diphenylhydrazone), 1-naphthalenecarbaldehyde 1-methyl-1-phenylhydrazone, 1-naphthalenecarbaldehyde 1,1-phenylhydrazone, 4-methoxynaphthlene-1-carbaldehyde 1-methyl-1-phenylhydrazone and the like. Other typical hydrazone transport molecules described, for example, in U.S. Pat. No. 4,150,987, U.S. Pat. No. 4,385,106, U.S. Pat. No. 4,338,388 and U.S. Pat. No. 4,387,147.

Carbazole phenyl hydrazone transport molecules such as 9-ethylcarbazole-3-carboaldehyde-1-methyl-1-phenyl hydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and the like. Other typical carbazole phenyl hydrazone transport molecules are described in U.S. Pat. No. 4,256,821 and U.S. Pat. No. 4,297,426.

Vinyl-aromatic polymers such as polyvinyl anthracene, polyacenaphthylene; formaldehyde condensation products with various aromatics such as condensates of formaldehyde and 3-bromopyrene; 2,4,7-trinitrofluorenone, and 3,6-dinitro-N-t-butyl-naphthalimide as described in U.S. Pat. No. 3,972,717.

Oxadiazole derivatives such as 2,5-bis-(p-diethylaminophenyl)oxadiazole-1,3,4 described in U.S. Pat. No. 3,895,944.

Tri-substituted methanes such as alkyl-bis(N,N-dialkylaminoaryl)methane, cycloalkyl-bis(N,N-dialkylaminoaryl)methane, and cycloalkenyl-bis(N,N-dialkylaminoaryl)methane as described in U.S. Pat. No. 3,820,989.

9-fluorenylidene methane derivatives having the formula:

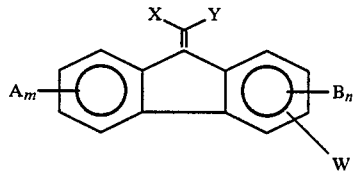

wherein X and Y are cyano groups or alkoxycarbonyl groups, A, B, and W are electron withdrawing groups independently selected from the group consisting of acyl, alkoxycarbonyl, nitro, alkylaminocarbonyl and derivatives thereof, m is a number of from 0 to 2, and n is the number 0 or 1 as described in copending in U.S. patent application Ser. No. 521,198, entitled Layered Photoresponsive Device, filed on Aug. 8, 1983. Typical 9-fluorenylidene methane derivatives encompassed by the above formula include (4-n-butoxycarbonyl-9-fluorenylidene)malonontrile, (4-phenethoxycarbonyl-9-fluorenylidene)malonontrile, (4-carbitoxy-9-fluorenylidene)malonontrile, (4-n-butoxycarbonyl-2,7-dinitro-9-fluorenylidene)malonate, and the like.

Other charge transport materials include as poly-1-vinylpyrene, poly-9-vinylanthracene, poly-9-(4-pentenyl)-carbazole, poly-9-(5-hexyl)-carbazole, polymethylene pyrene, poly-1-(pyrenyl)butadiene, polymers such as alkyl, nitro, amino, halogen, and hydroxy substitute polymers such as poly-3-amino carbazole, 1,3-dibromo-poly-N-vinyl carbazole and 3,6-dibromo-poly-N-vinyl carbazole and numerous other transparent organic polymeric or non-polymeric transport materials as described in U.S. Pat. No. 3,870,516.

The disclosures of each of the patents and pending patent application identified above pertaining to charge transport molecules which are soluble or dispersible on a molecular scale in a film forming binder are incorporated herein in their entirety.

When the charge transport materials are combined with an insulating binder to form the softenable layer, the amount of charge transport material which is used may vary depending upon the particular charge transport material and its compatibility (e.g. solubility) in the continuous insulating film forming binder phase of the softenable layer and the like. Satisfactory results have been obtained using between about 2 percent to about 50 percent by weight charge transport material based on the total weight of the softenable layer. A particularly preferred charge transport molecule is one having the general formula:

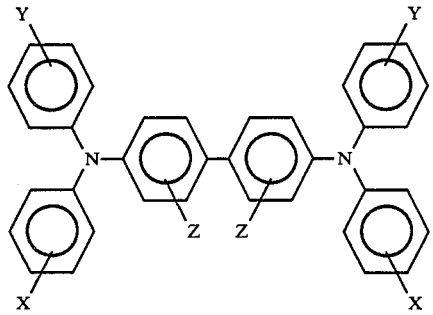

wherein X, Y and Z are selected from the group consisting of hydrogen, an alkyl group having from 1 to about 20 carbon atoms and chlorine and at least one of X, Y and Z is independently selected to be an alkyl group having from 1 to about 20 carbon atoms or chlorine. If Y and Z are hydrogen, the compound may be named N,N'-bis(alkylphenyl)-[1,1'-biphenyl]-4,4'-diamine wherein the alkyl is, for example, methyl, ethyl, propyl, n-butyl, etc. or the compound may be N,N'-diphenyl-N,N'-bis(chlorophenyl)-[1,1'-biphenyl]-4,4'-diamine. Excellent results including exceptional storage stability may be achieved when the softenable layer contains between about 5 percent to about 24 percent by weight of these diamine compounds based on the total weight of the softenable layer. Optimum results are achieved when the softenable layer contains between about 8 percent to about 20 percent by weight of N,N'-diphenyl-N,N'-bis(3''-methylphenyl)-(1,1'-biphenyl)-4,4'-diamine based on the total weight of the softenable layer. $D_{min}$ becomes noticably higher when the softenable layer contains less than about 5 percent by weight of these diamine compounds based on the total weight of the softenable layer, and $D_{min}$ increases and $D_{max}$ decreases when the softenable layer contains more than about 24 percent by weight of these diamine compounds based on the total weight of the softenable layer. Generally, when the diamine concentration in the softenable layer is either too low or too high, loss of contrast density is observed. Moreover, very large concentrations of these diamine compounds may cause crystallization of the compounds in the softenable layer.

The charge transport material may be incorporated into the softenable layer by any suitable technique. For example, it may be mixed with the softenable layer components by dissolution in a common solvent. If desired, a mixture of solvents for the charge transport material and softenable layer may be used to facilitate mixing and coating.

The charge transport material and softenable layer mixture may be applied to the substrate by any conventional coating process. Typical coating processes include draw bar, spraying, extrusion, dip, gravure roll, wire-wound rod, air knife coating and the like. The thickness of the deposited softenable layer after any drying or curing step is preferably in the range of about 0.5–2.5 micrometers. Somewhat thinner layers may be utilized, at the expense of slight increase in $D_{min}$, because sufficient room is required for both particle migration and particle coalescence. Thicker layers may also be utilized, but the time required for removal of solvents may become impractical and the trapped solvent in the layer may cause blocking.

Incorporation of the charge transport material into the softenable layer imparts to the migration imaging member the ability to form sign-reversed images using very simple processing steps, involving only a single charging step.

In FIG. 2, the overcoating layer 15 may be substantially electrically insulating, or have any other suitable properties. The overcoating 15 may also be transparent, translucent or opaque, depending upon the imaging system in which the overcoated member is to be used. The overcoating layer 15 is continuous and preferably of a thickness up to about 5 to 10 micrometers, although thicker overcoating layers may be suitable and desirable in some embodiments. For example, if the overcoating layer is electrically conductive, there are virtually no limitations on thickness, except for the practical ones of handling and economics. Preferably, the overcoating should have a thickness of at least about 0.1 micrometer and optimally, at least about 0.5 micrometer. Where the overcoating layer is electrically insulating and greater than about 5 to 10 micrometers thick, undesirably high electrical potentials may have a greater tendency to build up upon the imaging member during processing and migration imaging. Insulating overcoatings of between about 1 micrometer and about 5 micrometers are preferred to minimize charge trapping in the bulk of the overcoating layer 15. Typical overcoating materials include acrylic-styrene copolymers, methacrylate polymers, methacrylate copolymers, styrenebutylmethacrylate copolymers, butylmethacrylate resins, vinylchloride copolymers, fluorinated homo or copolymers, high molecular weight polyvinyl acetate, organosilicon polymers and copolymers, polyesters, polycarbonates, polyamides, polyvinyl toluene and the like. The overcoating layer 15 should protect the softenable layer 13 in order to provide greater resistance to the adverse effects of abrasion. The overcoating layer 15 may adhere strongly to the softenable layer 13 to assist the migration imaging member to survive adhesive tape removal without damage. The overcoating layer 15 may also have abhesive properties at its outer surface which provide improved insensitivity to fingerprints and blocking, and which further improve the capability of the migration imaging member to withstand adhesive tape removal. The adhesive properties may be inherent in the overcoating layer 15 or may be imparted to the overcoating layer 15 by incorporation of another layer or component of abhesive material. These abhesive materials should not degrade the film forming components of the overcoating and should preferably have a surface energy of less than about 20 ergs/cm$^2$. Typical abhesive materials include fatty acids, salts and esters, fluorocarbons, silicones and the like. The coatings may be applied by any suitable technique such as draw bar, spray, dip, melt, extrusion or gravure coating. It will be appreciated that these overcoating layers protect the migration imaging members before imaging, during imaging and after the members have been imaged.

The imaging members illustrated in FIGS. 1 and 2 are developed after charging and imagewise exposure by applying solvent vapor followed by the application of heat. If the substrate 11, conductive coating 12 and overcoating layer 15 are light transmitting, this imaged member may be highly light transmitting because of the selective agglomeration and coalescence of the migration marking material in the unexposed region. The vapor must be applied to the imaging member after imagewise exposure and prior to a final heat development step in order to achieve the exceptionally low $D_{min}$ for migration imaging members imaged with the process of this invention.

Figure 3A:
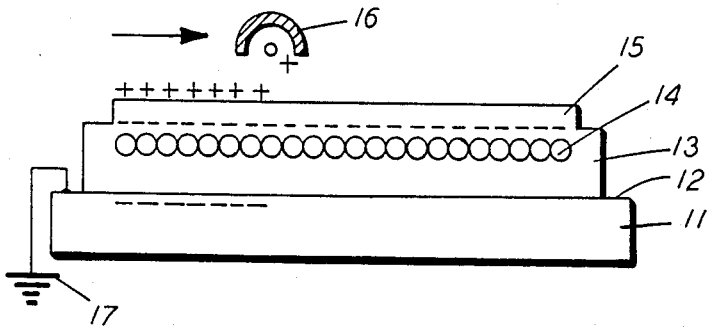
FIGS. 3A, 3B, 3C and 3D are partially schematic, cross-sectional views, of process steps to form migration images.

In FIG. 3A, an imaging member is shown comprising substrate 11 having conductive coating 12 thereon, softenable layer 13, a layer of migration marking material 14 contiguous the surface of the softenable layer 13 and overcoating 15 thereon. An electrical latent image may be formed on the imaging member by uniformly electrostatically charging the member and exposing the charged member to activating electromagnetic radiation prior to substantial dark decay of said uniform charge. The imaging member is shown in FIG. 3A as being electrostatically positively charged with corona charging device 16. Where substrate 11 is conductive or has a conductive coating 12, the conductive layer is grounded as shown at 17 or maintained at a predetermined potential during electrostatic charging. Another method of electrically charging a member having an insulating rather than a conductive substrate is to electrostatically charge both sides of the member to surface potentials of opposite polarities.

Figure 3B:
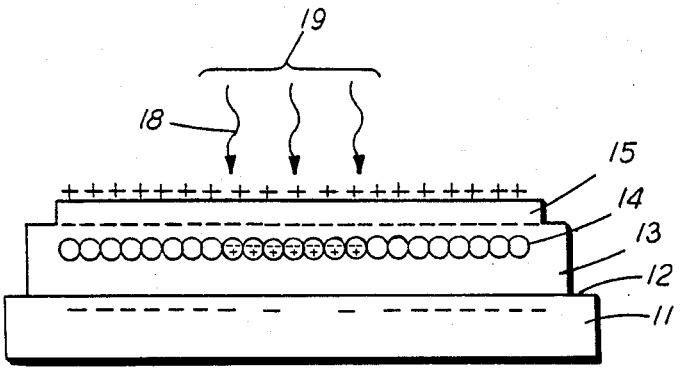

In FIG. 3B, the charged member is shown being exposed to activating electromagnetic radiation 18 in area 19 thereby forming an electrical latent image upon the imaging member. Exposure in an imagewise pattern to form an electrical latent image upon the imaging member should be effected prior to substantial dark decay of the deposited surface charge. Satisfactory results may be obtained if the dark decay is less than about 50 percent of the initial charge, thus the expression "prior to substantial decay" is intended to mean the dark decay is less than 50 percent of the initial charge. A dark decay of less than about 25 percent of the initial charge is preferred for optimum imaging.

Figure 3C:
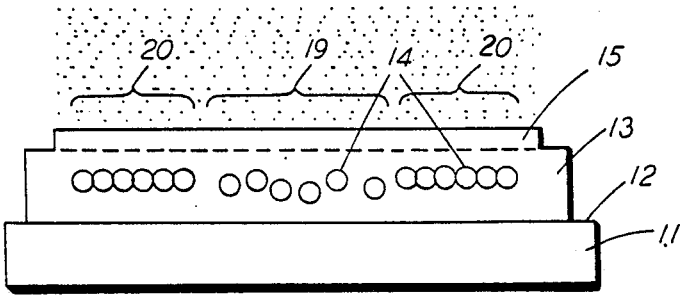

The member having the electrical latent image thereon is then exposed to solvent vapor (represented by dots) as shown in FIG. 3C. The vapor exposure time depends upon factors such as the solubility of softenable layer in the solvent, the type of solvent vapor, the ambient temperature and the concentration of the solvent vapors. Moreover, the presence or absence of an overcoating on the softenable layer can affect the exposure time. The slight net charge on the migration marking particles in the exposed area 19 coupled with the vapor treatment causes the migration marking particles to migrate slightly away from the softenable surface spaced from the substrate to increase separation between adjacent migration marking particles. This separation (assisted perhaps by the very small amount of charge remaining within the migration imaging particles after vapor exposure) is sufficient to prevent agglomeration or coalescence during the subsequent heating step. In the unexposed region, the surface charge becomes entirely discharged by vapor exposure. If desired, a heat treatment step may be used prior to the vapor exposure step to allow the slight net charge on the migration marking particles in the exposed area 19 to cause the migration marking particles to migrate slightly away from the softenable surface spaced from the substrate to increase separation between adjacent migration marking particles. Where such heat treatment step is used prior to the vapor exposure step, the vapor exposure step is still necessary to achieve the agglomeration described below with reference to FIG. 3D.

Figure 3D:
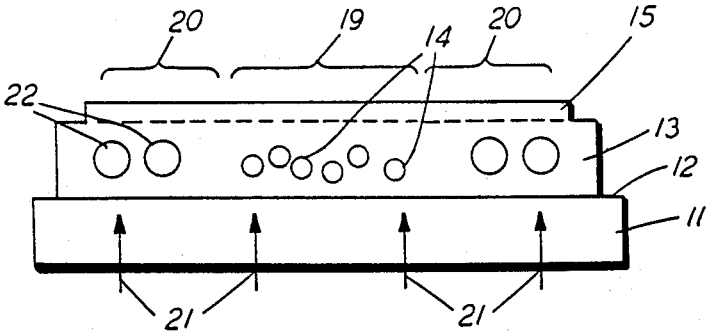

In FIG. 3D, the latent image is further developed by decreasing the resistance of the softenable material to migration of the particulate marking material by application of heat shown radiating into the softenable material at 21 to effect softening, whereby uncharged migration marking material is allowed to agglomerate and substantially coalesce to form larger particles 22 in in the unexposed areas 20. The position of the particles which have been exposed to light in area 19 remains substantially unchanged from the position taken during the vapor treatment step shown in FIG. 3C and these particles do not agglomerate or coalesce because they are no longer in close proximity to one-another due to the previous solvent vapor treatment. Thus, in FIG. 3D, the migration marking material is shown slightly migrated in area 19 (the exposed region) and in a coalesced state in areas 20 (the unexposed region). The areas 19 and 20 correspond to the formation of the electric latent image described in conjunction with FIGS. 3A and 3B. Thus, the process of the present invention produces negative images from positive originals or positive images from negative originals. Satisfactory results have been achieved with vapor exposure times of between about 10 seconds and about 2 minutes at 21° C. and development heating temperatures between about 80° C. and about 120° C. for 2 seconds to 2 minutes (the longer times being used with the lower temperatures) and with solvent vapor partial pressures of between about 20 mm of mercury and about 80 mm of mercury when the solvent is methyl ethyl ketone and the uncoated softenable layer contains a custom synthesized 80/20 mole percent copolymer of styrene and hexylmethacrylate having an intrinsic viscosity of 0.179 dl/gm and N,N'-diphenyl-N,N'-bis(3''-methylphenyl)-(1,1'-biphenyl)-4,4'-diamine. The test for a satisfactory combination of time, temperature and vapor concentration is maximized contrast density.

The migrated, imaged member illustrated in FIG. 3D is shown with the overcoating layer 15 thereon like that illustrated in FIG. 2. This overcoating layer 15 protects the imaging member prior to, during and after imaging. If desired, an uncoated imaging member like that illustrated in FIG. 1 may be substituted for the coated member illustrated in FIG. 2.

The imaged member shown in FIG. 3D is highly light transmitting in the unexposed region because of the selective agglomeration and coalescence of the migration marking material in the unexposed region. The $D_{min}$ obtained in the unexposed region is almost as low as the optical density of the substrate underlying the softenable layer. The $D_{max}$ in the exposed region is also high, because the migration marking material in the light-exposed regions only migrates slightly. Thus, sign-reversed images with high contrast density, in the region of 1.1 to 1.3, may be achieved with the process of this invention. In addition, exceptional resolution such as 228 line pairs per millimeter may be achieved with the process of this invention. The vapor must be applied to the imaging member after exposure but prior to a final heat development step in order to achieve these highly light transmitting images.

In the vapor-heat development, sign-reversing imaging process of this invention, it is believed that in order to achieve the excellent results of this invention most (between 50 and 95%, and preferably between 90 and 95%) of the photogenerated charge carriers of the same sign as the initially-applied ionic charge must be injected out of the light-exposed migration imaging particles (prior to or in the early stages of development by softening of the softenable layer). After loss (prior to or in the early stages of development) of the other sign of photogenerated charge (by injection out of the particles or by neutralization by the charge initially applied to the surface) only a small net charge is left in the light-exposed migration imaging particles. Charge injection of the first sign of charge is accomplished by the incorporation of charge transport materials into the softenable layer in this invention. Because the migration imaging particles gain only a very small amount of net charge in the light-exposed regions, exposure to solvent vapor during development causes only very slight migration of the migration imaging particles, and the optical density is only slightly reduced, for example to about 1.0 to 1.7, (preferably 1.2 to 1.7 or more, and more preferably 1.4 to 1.7 or more), compared with an initial value of about 1.8 to 1.9. Slight migration is necessary to prevent agglomeration during the final heating step, but it should not be excessive otherwise the $D_{max}$ (and consequently the contrast density) of the final sign-reversed image is degraded beyond the values given above. With conventional migration imaging members free of any charge transport material in the softenable layer, the exposed migration imaging particles gain an appreciable net charge and migrate considerably to produce a low optical-density region instead of a high optical-density region when processed with the vapor treatment-heat development steps of this invention.

Furthermore, in the vapor-heat development, sign-reversing imaging process of this invention, the unexposed particles do not become charged and do not migrate upon vapor exposure during the vapor treatment step (or during any heat treatment step that might be employed prior to the vapor treatment step), but remain substantially uncharged in the monolayer configuration to allow effective agglomeration and coalescence during the final heating step which follows the vapor treatment step. With conventional migration imaging members free of any charge transport material in the softenable layer, unexposed particles also generally remain substantially uncharged. Thus, the charge transport materials in the imaging members employed in the imaging process of this invention primarily alter the electrostatics of the light-exposed particles.

With positive corona charging of conventional migration imaging members free of any charge transport material in the softenable layer, the light-exposed migration imaging particles gain a net positive charge on vapor exposure. This resultant charge can be reduced to a reproducible low level if electron injection into the migration imaging particles also occurs on or after light exposure. This may be achieved with electron injecting molecules in the continuous matrix of the softenable layer. To achieve this charge injection, the Highest Occupied Molecular Orbital (HOMO) of at least one material in the continuous matrix of the softenable layer should not lie too far below the top of and may preferably lie above the top of the valence band of the migration imaging particles, otherwise this energy barrier will prevent injection, even if field assisted. According to this mechanism, electron injection into the light exposed migration imaging particles is sufficient to ensure their eventual near-neutrality; hole transport through the matrix of the softenable layer from the migration imaging particles to ground, while not harmful, is not necessary. On the other hand, the unexposed migration imaging particles must remain substantially neutral and not migrate out of the monolayer on vapor exposure; otherwise agglomeration and coalescence becomes very difficult. To prevent any dark charging (and, possibly, to prevent eventual near-total neutrality of the exposed migration imaging particles), no material in the matrix of the softenable layer must have a HOMO lying too far above the valence band of the migration imaging particles, otherwise an unacceptable level of charge exchange will occur with the unexposed migration imaging particles, causing them to migrate indiscriminately on vapor exposure. However this adverse effect of a relatively high-lying HOMO can be offset by using a relatively low concentration of the charge transport material, which is however, still enough to allow sufficient electron injection into the light-exposed particles. Thus, for satisfactory results with the preferred vapor-heat development imaging process of this invention, the HOMO of at least one material in the matrix of the softenable layer must not lie significantly below the top of and may preferably lie above the top of the valence band of the migration imaging particles, and if the HOMO of at least one charge transport material lies substantially above the top of the valence band of the migration imaging particles, this charge transport material should be used in relatively low concentration. The acceptable concentration of charge transport material will generally fall as a function of the difference between its HOMO and the valence band of the migration imaging particles. Suitable concentration of charge transport materials can be experimentally determined by maximizing the contrast density of the obtained sign-reversed images as a function of the concentration. It is often found, for example, that the concentration must be reduced below about 20% as the energy difference between the HOMO and the valence band rises above roughly 0.9–1.0 eV. The statement above that the HOMO should not lie "significantly below" the valence band means that the HOMO should not lie more than 0.1 eV, and preferably not more than 0.05 eV below the valence band; of course, it may lie above the valence band as described previously. Charge transport through the matrix of the softenable layer on exposure is not believed to be essential (though not harmful) for the foregoing mechanism and mere injection is sufficient.

It should be noted that the HOMO of most polymer materials used as softenable layers in migration imaging members, for example an 80/20 mole percent copolymer of styrene and hexylmethacrylate, lies well below the valence band of amorphous selenium migration imaging particles. Under these circumstances, there is negligible electron injection into the migration imaging particles on light exposure, unless a charge transport material (i.e one having an appropriate HOMO) is deliberately added.

Figure 4:
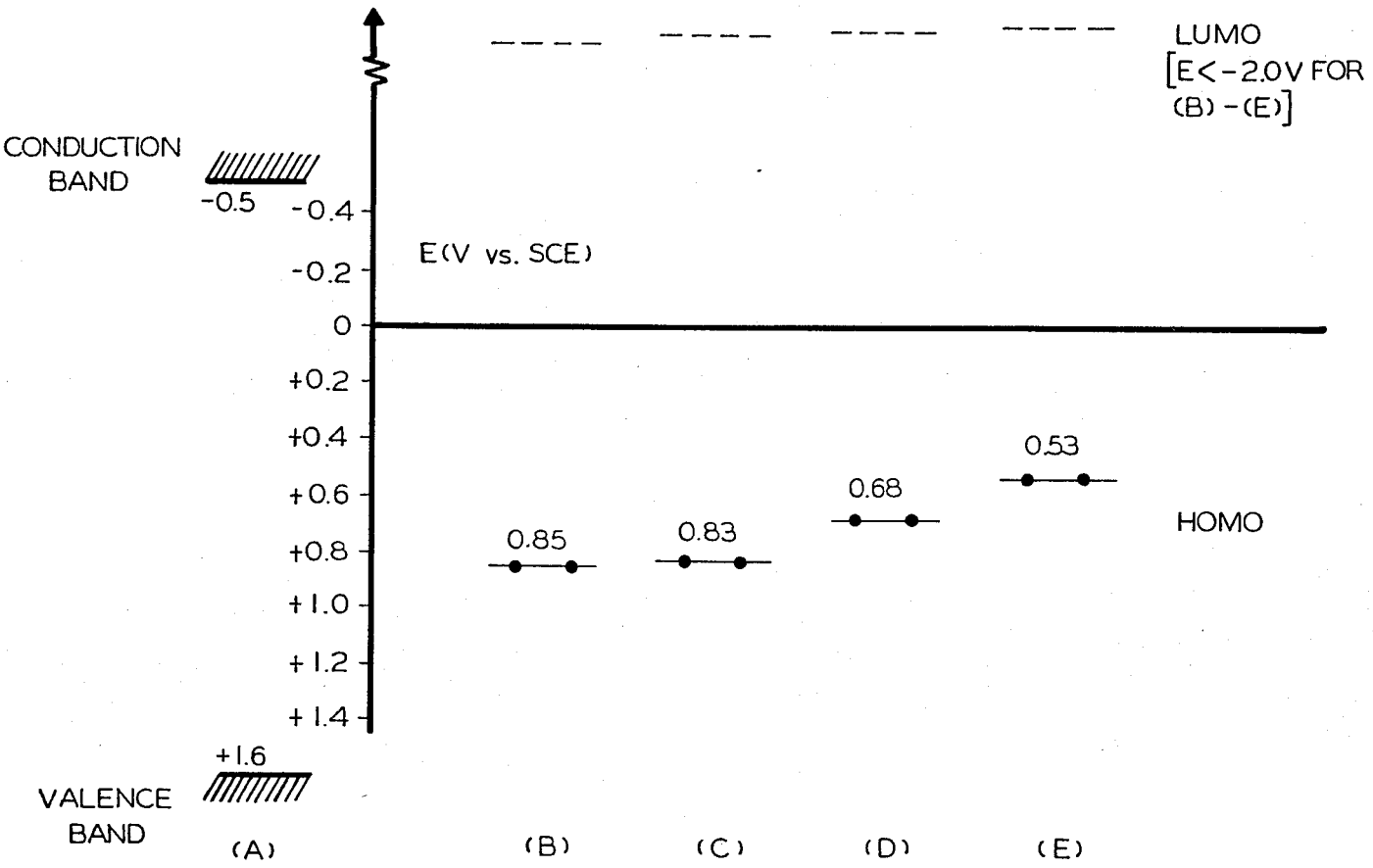
FIG. 4 is a graph illustrating the Highest Occupied Molecular Orbital and Lowest Unoccupied Molecular Orbital of softenable layer components.

The foregoing effect is demonstrated in FIG. 4 and also in the working examples below where N,N'-diphenyl-N,N'-bis(3''-methylphenyl)-(1,1'-biphenyl)-4,4'-diamine (B), 3-methyl diphenyl amine (C), 4,4'-Benzylidene bis(N,N-diethyl-m-toluidene) (D), and p-diethylamino benzaldehyde-(diphenyl hydrazone) (E) are incorporated into a conventional softenable layer matrix. These materials are shown in a potential energy diagram in FIG. 4, which indicates that all of the respective HOMO's lie above the valence band of amorphous selenium (A). The first two, N,N'-diphenyl-N,N'-bis(3''-methylphenyl)(1,1'-biphenyl)-4,4'-diamine (B) and 3-methyl diphenyl amine (C), provide good vapor-heat development sign-reversing images at about the 20 percent concentration level. While N,N'-diphenyl-N,N'-bis(3''-methylphenyl)-(1,1'-biphenyl)-4,4'-diamine (B) gives good injection and transport on light exposure (resulting in near total film voltage discharge), 3-methyl diphenyl amine (C) gives good injection but very poor transport (resulting in a high residual voltage), showing that transport after injection and prior to development is not critical for good imaging. 4,4'-Benzylidene bis(N,N-diethyl-m-toluidene) (D) and p-diethylamino benzaldehyde-(diphenyl hydrazone) (E), whose HOMO's lie further above the valence band of amorphous selenium, provide only indiscriminate migration (to an optical density of ~1.4) on vapor exposure (even without any corotron charging of the film) when incorporated at about the 20 percent level. However, if the concentration is reduced to about the 3 percent level both the 4,4'-Benzylidene bis(N,N-diethyl-m-toluidene) (D) and the p-diethylamino benzaldehyde-(diphenyl hydrazone) (E) allow vapour-heat sign-reversing imaging.

The following discussion relates to the converse situation of negative corona charging. With negative corona charging of conventional migration imaging members free of any charge transport material in the softenable layer, the light exposed migration imaging particles gain a substantial negative charge on vapor exposure. This gaining of a substantial negative charge must be prevented for satisfactory results with the preferred vapor-heat development process embodiment of this invention. It is believed that the necessary hole injection into the migration imaging particles to prevent this can occur if the Lowest Unoccupied Molecular Orbital (LUMO) of at least one matrix component (i.e. that of a hole injecting material) in the continuous matrix of the softenable layer lies below the bottom of (or at least not significantly above the bottom of) the conduction band of the migration imaging particles. Moreover, to prevent undesirable dark charging of the migration imaging particles, no substantial matrix component must have a LUMO which lies too far below the conduction band of the migration imaging particles. If the LUMO of any significant matrix component lies substantially below the conduction band of the migration imaging particles, this matrix component should be used in a relatively low concentration. The acceptable concentration of charge transport material will generally fall as a function of the difference between its LUMO and the conduction band of the migration imaging particles. Suitable concentration of charge transport materials can be experimentally determined by maximizing the contrast density of the obtained sign-reversed images as a function of the concentration. According to this mechanism, it is believed that hole injection into the light-exposed migration imaging particles is sufficient to ensure their eventual near-neutrality; charge transport through the matrix from the migration imaging particles to ground on exposure is neither essential nor harmful. It should be noted that the LUMO of typical polymeric materials used for the softenable layer of migration imaging members, for example an 80/20 mole percent copolymer of styrene and hexylmethacrylate, lies well above the conduction band of amorphous selenium (A); hence there should be negligible hole injection into the particles on light exposure unless a charge transport material (i.e. one with an appropriate LUMO) is deliberately added.

Combinations of the charge transport material and the migration imaging particles listed above and below which meet the above HOMO or LUMO requirements should, of course, also meet the normal requirement of compatibility with any softenable material used in the matrix. For example, where the charge transport material is to be dissolved or molecularly dispersed in an insulating film-forming binder, the combination of the charge transport material and the insulating film-forming binder should be such that the charge transport material may be incorporated into the film-forming binder in sufficient concentration levels while still remaining in solution or molecularly dispersed. If desired, the insulating film-forming binder need not be utilized where the charge transport material is a polymeric film-forming material.

The invention will now be described in detail with respect to specific preferred embodiments thereof, it being noted that these examples are intended to be illustrative only and are not intended to limit the scope of the present invention. Parts and percentages are by weight unless otherwise indicated.

EXAMPLE I

An imaging member similar to that illustrated in FIG. 1 was prepared by dissolving about 13 percent by weight of 80/20 mole percent copolymer of styrene and hexylmethacrylate and about 1.0 percent by weight of N,N'-diphenyl-N,N'-bis(3''-methylphenyl)-(1,1'-biphenyl)-4,4'-diamine in about 86 percent by weight toluene based on the total weight of the solution. The resulting solution was applied by means of a Dilts coater onto a 12 inch wide 3 mil Mylar polyester film (available from E. I. duPont deNemours Co.) having a thin, semitransparent aluminum coating. The deposited softenable layer was allowed to dry at about 110° C. for about 15 minutes. The temperature of the softenable layer was raised to about 115° C. to lower the viscosity of the exposed surface of the softenable layer to about $5\times10^3$ poises in preparation for the deposition of marking material. A thin layer of particulate vitreous selenium was then applied by vacuum deposition in a vacuum chamber maintained at a vacuum of about $4\times10^{-4}$ Torr. The imaging member was then rapidly chilled to room temperature. A monolayer of selenium particles having an average diameter of about 0.3 micrometer embedded about 0.05–0.1 micrometer below the exposed surface of the copolymer was formed. The resulting migration imaging member was thereafter imaged and developed by a combination of vapor and heat processing techniques comprising the steps of corotron charging to a surface potential of about +168 volts, exposing to activating radiation through a step-wedge, exposure to n-ethylacetate in a vapour chamber for about 6 seconds and heating to about 115° C. for about 2 seconds on a hot plate in contact with the Mylar. The resulting sign-reversed imaged migration imaging member exhibited excellent image quality, resolution in excess of 228 line pairs per millimeter, and a contrast density of about 0.92. $D_{max}$ was about 1.18 and the $D_{min}$ was about 0.26. It was also found that the very low $D_{min}$ was due to agglomeration and coalescence of the selenium particles in the $D_{min}$ regions of the image. A black and white image is observed when the resulting imaged migration imaging member is projected on a screen using white light for projection; this is quite different from images made using similar migration imaging members having no charge transport material, and using development by either heat or exposure to solvent vapor, which are red and blue. It was further found that the images obtained by the processes of this example were unusually insensitive to the precise processing conditions, compared with images made using similar migration imaging members having no charge transport material.

EXAMPLE II

A fresh imaging member was prepared as described in Example I. The resulting migration imaging member was thereafter imaged and developed by a combination of vapor and heat processing techniques comprising the steps of corotron charging to a surface potential of about +168 volts, exposing to activating radiation through a stepwedge, exposure to 1,1,1 trichloroethane in a vapor chamber for about 6 seconds and heating to about 115° C. for about 5 seconds on a hot plate in contact with the Mylar. The resulting sign-reversed imaged migration imaging member exhibited excellent image quality, and a contrast density of about 0.84. $D_{max}$ was about 1.10 and $D_{min}$ was about 0.26. It was also found that the very low $D_{min}$ was due to agglomeration and coalescence of the selenium particles in the $D_{min}$ regions of the image. A black and white image is observed when the resulting imaged migration imaging member is projected on a screen using white light for projection. It was further found that the images obtained by the processes of this example were unusually insensitive to the precise processing conditions.

EXAMPLE III

A fresh imaging member was prepared as described in Example I and overcoated with a water-borne solution containing about 10 percent by weight of styrene-acrylic copolymer (Neocryl A-622, available from Polyvinyl Chemical Industries) and about 0.03 percent by weight of polysiloxane resin (Byk 301, available from Byk-Mallinckodt). The dried overcoat had a thickness of about 1.5 micrometers. The resulting overcoated migration imaging member was thereafter imaged and developed by a combination of vapor and heat processing techniques comprising the steps of corotron charging to a surface potential of about +250 volts, exposing to activating radiation through a step-wedge, exposure to methyl ethyl ketone in a vapor chamber for about 20 seconds, and heating to about 115° C. for about 5 seconds on a hot plate in contact with the Mylar. The resulting sign-reversed imaged migration imaging member exhibited excellent image quality and a contrast density of about 1.2. $D_{max}$ was about 1.45 and $D_{min}$ was about 0.25. The imaged member exhibited excellent abrasion resistance when scraped with a finger nail and excellent finger print resistance when attempts were made to apply fingerprints to the imaging member before and after imaging. The overcoated migration imaging member also retained its integrity when subjected to a very severe adhesive-tape test with Scotch brand "Magic" adhesive tape. It was also found that the very low $D_{min}$ was due to agglomeration and coalescence of the selenium particles in the $D_{min}$ regions of the image. It was further found that the images obtained by the processes of this example were unusually insensitive to the precise processing conditions.

EXAMPLE IV

A fresh overcoated imaging member was prepared as described in Example III. The resulting overcoated migration imaging member was thereafter imaged and developed by a combination of vapor and heat processing techniques comprising the steps of corotron charging to a surface potential of about +250 volts, exposing to activating radiation through a step-wedge, exposure to methyl ethyl ketone in a vapor chamber for about 20 seconds, and heating to about 95° C. for about 10 seconds on a hot plate in contact with the Mylar. The resulting sign-reversed imaged migration imaging member exhibited excellent image quality and a contrast density of about 1.2 $D_{max}$ was about 1.45 and $D_{min}$ was about 0.25. The imaged member exhibited excellent abrasion resistance when scraped with a finger nail and excellent finger print resistance when attempts were made to apply fingerprints to the imaging member before and after imaging. The overcoated migration imaging member also retained its integrity when subjected to a very severe adhesive tape test with Scotch brand "Magic" adhesive tape. It was also found that the very low $D_{min}$ was due to agglomeration and coalescence of the selenium particles in the $D_{min}$ regions of the image. It was further found that the images obtained by the processes of this example were unusually insensitive to the precise processing conditions.

EXAMPLE V

A fresh imaging member was prepared as described in Example I and overcoated with styrene-acrylic copolymer (Neocryl A 622, available from Polyvinyl Chemical Industries). The dried overcoat had a thickness of about 1.5 micrometers. The resulting overcoated migration imaging member was thereafter imaged and developed by a combination of vapor and heat processing techniques comprising the steps of corotron charging to a surface potential of about +250 volts, exposing to activating radiation through a step-wedge, exposure to methyl ethyl ketone in a vapor chamber for about 20 seconds, and heating to about 115° C. for about 5 seconds on a hot plate in contact with the Mylar. The resulting sign-reversed imaged migration imaging member exhibited excellent image quality and a contrast density of about 1.1 $D_{max}$ was about 1.4 and $D_{min}$ was about 0.3. The imaged member exhibited excellent abrasion resistance when scraped with a finger nail and excellent finger print resistance when attempts were made to apply fingerprints to the imaging member before and after imaging. The overcoated migration imaging member also retained its integrity when subjected to a very severe adhesive-tape test with Scotch brand "Magic" adhesive tape. It was also found that the very low $D_{min}$ was due to agglomeration and coalescence of the selenium particles in the $D_{min}$ regions of the image. It was further found that the images obtained by the processes of this example were unusually insensitive to the precise processing conditions.

EXAMPLE VI

A fresh imaging member was prepared as described in Example I and overcoated with a water-based acrylic copolymer (A-1054, available from Polyvinyl Chemical, U.S.A.). The dried overcoat had a thickness of about 1.5 micrometers. The resulting overcoated migration imaging member was thereafter imaged and developed by a combination of vapor and heat processing techniques comprising the steps of corotron charging to a surface potential of about +250 volts, exposing to activating radiation through a step-wedge, exposure to methyl ethyl ketone in a vapor chamber for about 20 seconds, and heating to about 115° C. for about 5 seconds on a hot plate in contact with the Mylar. The resulting sign-reversed imaged migration imaging member exhibited excellent image quality and a contrast density of about 1.25. $D_{max}$ was about 1.55 and $D_{min}$ was about 0.3. The imaged member exhibited excellent abrasion resistance when scraped with a finger nail and excellent finger print resistance when attempts were made to apply fingerprints to the imaging member before and after imaging. The overcoated migration imaging member also retained its integrity when subjected to a very severe adhesive-tape test with Scotch brand "Magic" adhesive tape. It was also found that the very low $D_{min}$ was due to agglomeration and coalescence of the selenium particles in the $D_{min}$ regions of the image. It was further found that the images obtained by the processes of this example were unusually insensitive to the precise processing conditions.

EXAMPLE VII

An imaging member similar to that illustrated in FIG. 1 was prepared by dissolving about 13 percent by weight of 80/20 mole percent copolymer of styrene and hexylmethacrylate and about 1.0 percent by weight of N,N'-diphenyl-N,N'-bis(3''-methylphenyl)-(1,1'-biphenyl)-4,4'-diamine in about 86 percent by weight toluene based on the total weight of the solution. The resulting solution was applied by means of a Dilts coater onto a 12 inch wide 3 mil Mylar polyester film (available from E. I. duPont deNemours Co.) having a thin, semitransparent aluminum coating. The deposited softenable layer was allowed to dry at about 110° C. for about 15 minutes. The temperature of the softenable layer was raised to about 115° C. to lower the viscosity of the exposed surface of the softenable layer to about $5\times10^3$ poises in preparation for the deposition of marking material. A thin layer of particulate vitreous alloy of about 95 percent by weight selenium and about 5 percent by weight tellurium was then applied by vacuum deposition in a vacuum chamber maintained at a vacuum of about $4\times10^{-4}$ Torr. The imaging member was then rapidly chilled to room temperature. A monolayer of selenium alloy particles having an average diameter of about 0.3 micrometer embedded about 0.05–0.1 micrometer below the exposed surface of the copolymer was formed. The resulting migration imaging member was thereafter imaged and developed by a combination of vapor and heat processing techniques comprising the steps of corotron charging to a surface potential of about +168 volts, exposing to activating radiation through a stepwedge, exposure to n-ethylacetate in a vapor chamber for about 6 seconds and heating to about 115° C. for about 2 seconds on a hot plate in contact with the Mylar. The resulting sign-reversed imaged migration imaging member exhibited excellent image quality, resolution in excess of 228 line pairs per millimeter, and a contrast density of about 0.7. $D_{max}$ was about 1.0 and $D_{min}$ was about 0.3. This migration imaging member had greater spectral sensitivity range than migration imaging members comprising selenium migration imaging particles. It was also found that the very low $D_{min}$ was due to agglomeration and coalescence of the selenium alloy particles in the $D_{min}$ regions of the image. It was further found that the images obtained by the processes of this example were unusually insensitive to the precise processing conditions.

EXAMPLE VIII

An imaging member similar to that illustrated in FIG. 1 was prepared by dissolving about 13 percent by weight of 80/20 mole percent copolymer of styrene and hexylmethacrylate and about 2.5 percent by weight of N,N'-diphenyl-N,N'-bis(3''-methylphenyl)-(1,1'-biphenyl)-4,4'-diamine in about 84.5 percent by weight toluene based on the total weight of the solution. The resulting solution was applied by means of a Meyer rod onto a 12 inch wide 3 mil Mylar polyester film (available from E. I. duPont deNemours Co.) having a thin, semitransparent aluminum coating. The deposited softenable layer was allowed to dry at about 90° C. for about 10 minutes. The temperature of the softenable layer was raised to about 115° C. to lower the viscosity of the exposed surface of the softenable layer to about $5\times10^3$ poises in preparation for the deposition of marking material. A thin layer of particulate vitreous selenium was then applied by vacuum deposition in a vacuum chamber maintained at a vacuum of about $4\times10^{-4}$ Torr. The imaging member was then rapidly chilled to room temperature. A monolayer of selenium particles having an average diameter of about 0.3 micrometer embedded about 0.05–0.1 micrometer below the exposed surface of the copolymer was formed. The resulting migration imaging member was thereafter imaged and developed by a combination of vapor and heat processing techniques comprising the steps of corotron charging to a surface potential of about +150 volts, exposing to activating radiation through a stepwedge, exposing the member to methyl ethyl ketone vapor in a vapor chamber for about 10 seconds, and heating to about 115° C. for about 5 seconds on a hot plate in contact with the Mylar. The resulting sign-reversed imaged migration imaging member exhibited excellent image quality and a contrast density of about 0.9. $D_{max}$ was about 1.2 and the $D_{min}$ was about 0.3. It was also found that the very low $D_{min}$ was due to agglomeration and coalescence of the selenium particles in the $D_{min}$ regions of the image. A black and white image is observed when the resulting imaged migration imaging member is projected on a screen using white light for projection. It was further found that the presence of N,N'-diphenyl-N,N'-bis(3''-methylphenyl)-(1,1'-biphenyl)4,4'-diamine in the softenable layer yields good injection and transport on light exposure, with ~85% film voltage discharge.

EXAMPLE IX

An imaging member similar to that illustrated in FIG. 1 was prepared by dissolving about 13 percent by weight of 80/20 mole percent copolymer of styrene and hexylmethacrylate and about 2.5 percent by weight of 3-methyl diphenyl amine in about 84.5 percent by weight toluene based on the total weight of the solution. The resulting solution was applied by means of a Meyer rod onto a 12 inch wide 3 mil Mylar polyester film (available from E. I. duPont deNemours Co.) having a thin, semi-transparent aluminum coating. The deposited softenable layer was allowed to dry at about 90° C. for about 10 minutes. The temperature of the softenable layer was raised to about 115° C. to lower the viscosity of the exposed surface of the softenable layer to about $5\times10^3$ poises in preparation for the deposition of marking material. A thin layer of particulate vitreous selenium was then applied by vacuum deposition in a vacuum chamber maintained at a vacuum of about $4\times10^{-4}$ Torr. The imaging member was then rapidly chilled to room temperature. A monolayer of selenium particles having an average diameter of about 0.3 micrometer embedded about 0.05–0.1 micrometer below the exposed surface of the copolymer was formed. The resulting migration imaging member was thereafter imaged and developed by a combination of vapor and heat processing techniques comprising the steps of corotron charging to a surface potential of about +150 volts, exposing to activating radiation through a step-wedge, exposing the member to methyl ethyl ketone vapor in a vapor chamber for about 10 seconds, and heating to about 115° C. for about 5 seconds on a hot plate in contact with the Mylar. The resulting sign-reversed imaged migration imaging member exhibited excellent image quality and a contrast density of about 0.9. $D_{max}$ was about 1.2 and the $D_{min}$ was about 0.3. It was also found that the very low $D_{min}$ was due to agglomeration and coalescence of the selenium particles in the $D_{min}$ regions of the image. A black and white image is observed when the resulting imaged migration imaging member is projected on a screen using white light for projection. It was further found that the presence of 3-methyldiphenylamine in the softenable layer results in poor transport through the softenable layer (as indicated by an ~20% film voltage discharge on light exposure) thereby demonstrating in conjunction with the results of the immediately preceding Example that through the softenable layer transport immediately after injection is apparently not critical for good imaging.

EXAMPLE X

An imaging member similar to that illustrated in FIG. 1 was prepared by dissolving about 13 percent by weight of 80/20 mole percent copolymer of styrene and hexylmethacrylate and about 0.4 percent by weight of 4,4'-Benzylidene bis(N,N-diethyl-m-toluidene) in about 86.6 percent by weight toluene based on the total weight of the solution. The resulting solution was applied by means of a Meyer rod onto a 12 inch wide 3 mil Mylar polyester film (available from E. I. duPont deNemours Co.) having a thin, semi-transparent aluminum coating. The deposited softenable layer was allowed to dry at about 90° C. for about 10 minutes. The temperature of the softenable layer was raised to about 115° C. to lower the viscosity of the exposed surface of the softenable layer to about $5\times10^3$ poises in preparation for the deposition of marking material. A thin layer of particulate vitreous selenium was then applied by vacuum deposition in a vacuum chamber maintained at a vacuum of about $4\times10^{-4}$ Torr. The imaging member was then rapidly chilled to room temperature. A monolayer of selenium particles having an average diameter of about 0.3 micrometer embedded about 0.05–0.1 micrometer below the exposed surface of the copolymer was formed. The resulting migration imaging member was thereafter imaged and developed by a combination of vapor and heat processing techniques comprising the steps of corotron charging to a surface potential of about +150 volts, exposing to activating radiation through a step-wedge, exposing the member to methyl ethyl ketone vapor in a vapor chamber for about 10 seconds, and heating to about 115° C. for about 5 seconds on a hot plate in contact with the Mylar. The resulting sign-reversed imaged migration imaging member exhibited reasonable image quality and a contrast density of about 0.55. $D_{max}$ was about 1.4 and the $D_{min}$ was about 0.85. It is believed that the $D_{min}$ was due to partial agglomeration and coalescence of the selenium particles. The film voltage discharge on light exposure was ~70%.

EXAMPLE XI

An imaging member similar to that illustrated in FIG. 1 was prepared by dissolving about 13 percent by weight of 80/20 mole percent copolymer of styrene and hexylmethacrylate and about 2.5 percent by weight of 4,4'-Benzylidene bis(N,N-diethyl-m-toluidene) in about 84.5 percent by weight toluene based on the total weight of the solution. The resulting solution was applied by means of a Meyer rod onto a 12 inch wide 3 mil Mylar polyester film (available from E. I. duPont deNemours Co.) having a thin, semi-transparent aluminum coating. The deposited softenable layer was allowed to dry at about 90° C. for about 10 minutes. The temperature of the softenable layer was raised to about 115° C. to lower the viscosity of the exposed surface of the softenable layer to about $5\times10^3$ poises in preparation for the deposition of marking material. A thin layer of particulate vitreous selenium was then applied by vacuum deposition in a vacuum chamber maintained at a vacuum of about $4\times10^{-4}$ Torr. The imaging member was then rapidly chilled to room temperature. A monolayer of selenium particles having an average diameter of about 0.3 micrometer embedded about 0.05–0.1 micrometer below the exposed surface of the copolymer was formed. The resulting migration imaging member was thereafter imaged and developed by a combination of vapor and heat processing techniques comprising the steps of corotron charging to a surface potential of about +150 volts, exposing to activating radiation through a step-wedge, exposing the member to methyl ethyl ketone vapor in a vapor chamber for about 10 seconds, and heating to about 115° C. for about 5 seconds on a hot plate in contact with the Mylar. As illustrated in FIG. 4, the HOMO of 4,4'-Benzylidene bis(N,N-diethyl-m-toluidene) is considerably above the valence band of amorphous selenium and this concentrated formulation therefore yielded only uniform migration (to an optical density of about 1.4) on vapor exposure, and no reduction of optical density due to coalescence took place on subsequent heating. Similar behavior was observed even without any corotron charging of the film. Thus, this adverse effect of a relatively high-lying HOMO can be offset as illustrated in the immediately preceding Example by using a relatively low concentratrion of the charge transfer molecule which is present in adequate quantity to allow sufficient injection on exposure.

EXAMPLE XII

An imaging member similar to that illustrated in FIG. 1 was prepared by dissolving about 13 percent by weight of 80/20 mole percent copolymer of styrene and hexylmethacrylate and about 0.4 percent by weight of p-diethylamino benzaldehyde-(diphenyl hydrazone) in about 86.6 percent by weight toluene based on the total weight of the solution. The resulting solution was applied by means of a Meyer rod onto a 12 inch wide 3 mil Mylar polyester film (available from E. I. duPont deNemours Co.) having a thin, semi-transparent aluminum coating. The deposited softenable layer was allowed to dry at about 90° C. for about 10 minutes. The temperature of the softenable layer was raised to about 115° C.

to lower the viscosity of the exposed surface of the softenable layer to about $5\times10^3$ poises in preparation for the deposition of marking material. A thin layer of particulate vitreous selenium was then applied by vacuum deposition in a vacuum chamber maintained at a vacuum of about $4\times10^{-4}$ Torr. The imaging member was then rapidly chilled to room temperature. A monolayer of selenium particles having an average diameter of about 0.3 micrometer embedded about 0.05–0.1 micrometer below the exposed surface of the copolymer was formed. The resulting migration imaging member was thereafter imaged and developed by a combination of vapor and heat processing techniques comprising the steps of corotron charging to a surface potential of about +150 volts, exposing to activating radiation through a step-wedge, exposing the member to methyl ethyl ketone vapor in a vapor chamber for about 10 seconds, and heating to about 115° C. for about 5 seconds on a hot plate in contact with the Mylar. The resulting sign-reversed imaged migration imaging member exhibited excellent image quality and a contrast density of about 0.9. $D_{max}$ was about 1.55 and the $D_{min}$ was about 0.65. It was also found that the $D_{min}$ was due to partial agglomeration and coalescence of the selenium particles. A black and white image is observed when the resulting imaged migration imaging member is projected on a screen using white light for projection. It was further found that the images obtained by the processes of this example were unusually insensitive to the precise processing conditions.

EXAMPLE XIII

An imaging member similar to that illustrated in FIG. 1 was prepared by dissolving about 13 percent by weight of 80/20 mole percent copolymer of styrene and hexylmethacrylate and about 2.5 percent by weight of p-diethylamino benzaldehyde-(diphenyl hydrazone) in about 84.5 percent by weight toluene based on the total weight of the solution. The resulting solution was applied by means of a Meyer rod onto a 12 inch wide 3 mil Mylar polyester film (available from E. I. duPont deNemours Co.) having a thin, semi-transparent aluminum coating. The deposited softenable layer was allowed to dry at about 90° C. for about 10 minutes. The temperature of the softenable layer was raised to about 115° C. to lower the viscosity of the exposed surface of the softenable layer to about $5\times10^3$ poises in preparation for the deposition of marking material. A thin layer of particulate vitreous selenium was then applied by vacuum deposition in a vacuum chamber maintained at a vacuum of about $4\times10^{-4}$ Torr. The imaging member was then rapidly chilled to room temperature. A monolayer of selenium particles having an average diameter of about 0.3 micrometer embedded about 0.05–0.1 micrometer below the exposed surface of the copolymer was formed. The resulting migration imaging member was thereafter imaged and developed by a combination of vapor and heat processing techniques comprising the steps of corotron charging to a surface potential of about +150 volts, exposing to activating radiation through a step-wedge, exposing the member to methyl ethyl ketone vapor in a vapor chamber for about 10 seconds, and heating to about 115° C. for about 5 seconds on a hot plate in contact with the Mylar. As illustrated in FIG. 4, the HOMO of p-diethylamino benzaldehyde-(diphenyl hydrazone) is considerably above the valence band of amorphous selenium and this concentrated formulation therefore yielded only uniform migration (to an optical density of about 1.4) on vapor exposure, and no reduction of optical density due to coalescence took place on subsequent heating. Similar behavior was observed even without any corotron charging of the film. Thus, this adverse effect of a relatively high-lying HOMO can be offset as illustrated in the immediately preceding Example by using a relatively low concentratrion of the charge transfer molecule which is present in adequate quantity to allow sufficient injection on exposure.

Other modifications of the present invention will occur to those skilled in the art based upon a reading of the present disclosure. Thus, for example, a second charging step to reduce the surface voltage down to near zero may be utilized prior to the vapor exposure step. This second charging step is of an opposite polarity to the first. These are intended to be included within the scope of this invention.

I claim:

1. An imaging method comprising providing a migration imaging member comprising a substrate and an electrically insulating softenable layer on said substrate, said softenable layer comprising a charge transport molecule and a fracturable layer of electrically photosensitive migration marking material located substantially at or near the surface of said softenable layer spaced from said substrate, said charge transport molecule being predominantly nonabsorbing in the spectral region at which said electrically photosensitive migration marking material photogenerates charge carriers, being capable of increasing charge injection from said electrically photosensitive migration marking material to said softenable layer and being dissolved or molecularly dispersed in said softenable layer, electrostatically charging said member, exposing said member to activating radiation in an imagewise pattern whereby said electrically photosensitive migration marking material stuck by said activating radiation photogenerates charge carriers, decreasing the resistance to migration of migration marking marking material in said softenable layer sufficiently by exposure to solvent vapor to allow slight migration in depth of migration marking material towards said substrate in image configuration, and further decreasing the resistance to migration of marking material in said softenable layer sufficiently by heating to allow nonmigrated marking material to agglomerate.

2. An imaging method in accordance with claim 1 wherein said migration of said migration marking material begins in areas of said softenable layer corresponding to said imagewise pattern which are struck by said activating radiation when the resistance to migration of marking material in said softenable layer sufficiently decreased to allow slight migration in depth of marking material towards said substrate in image configuration thereby forming $D_{max}$ areas in areas of said softenable layer corresponding to said imagewise pattern which are struck by said activating radiation.

3. An imaging method in accordance with claim 2 including exposing of said member to sufficient vapor of a solvent for said softenable layer to decrease said resistance to migration of migration marking material in said softenable layer thereby allowing slight migration in depth of migration marking material towards said substrate in image configuration in areas of said softenable layer corresponding to said imagewise pattern which are struck by said activating radiation.

4. An imaging method in accordance with claim 1 wherein said agglomeration of said marking material in areas of said softenable layer corresponding to said imagewise pattern which escaped exposure to said activating radiation begins during said further decreasing of the resistance to migration of migration marking material in said softenable layer.

5. An imaging method in accordance with claim 4 including heat softening said softenable layer to begin said agglomeration of said migration marking material in areas of said softenable layer corresponding to said imagewise pattern which escaped exposure to said activating radiation.

6. An imaging method in accordance with claim 5 wherein said migration marking material agglomerates and substantially coalesces in areas of said softenable layer corresponding to said imagewise pattern which escaped exposure to said activating radiation during said heat softening of said softenable layer thereby forming $D_{min}$ areas.

7. An imaging method in accordance with claim 1 wherein said softenable layer comprises about 2 percent to about 50 percent by weight of said charge transport molecule based on the total weight of said softenable layer.

8. An imaging method in accordance with claim 1 wherein said fracturable layer is a monolayer.

9. An imaging method in accordance with claim 1 wherein said migration imaging member includes a protective overcoating comprising a film forming resin on said softenable layer.

10. An imaging method in accordance with claim 1 including exposing said member to sufficient vapor of a solvent for said material in the softenable layer whereby slight migration in depth of marking material towards said substrate in image configuration occurs, and further decreasing the resistance to migration of marking material in said softenable layer by sufficiently heating said member to allow nonmigrated marking material to agglomerate and coalesce.

11. An imaging method comprising providing a migration imaging member comprising a substrate and an electrically insulating softenable layer on said substrate, said softenable layer comprising a substituted, unsymmetrical tertiary amine charge transport molecule and a fracturable monolayer of electrically photosensitive migration marking material located substantially at or near the surface of said softenable layer spaced from said substrate, said charge transport molecule being predominantly nonabsorbing in the spectral region at which said electrically photosensitive migration marking material photogenerates charge carriers, being capable of increasing charge injection from said electrically photosensitive migration marking material to said softenable layer and being dissolved or molecularly dispersed in said softenable layer, electrostatically charging said member, exposing said member to activating radiation in an imagewise pattern whereby said electrically photosensitive migration marking material stuck by said activating radiation photogenerates charge carriers, decreasing the resistance to migration of migration marking marking material in said softenable layer sufficiently to allow slight migration in depth of migration marking material towards said substrate in image configuration, and further decreasing the resistance to migration of marking material in said softenable layer sufficiently to allow nonmigrated marking material to agglomerate.

12. An imaging method in accordance with claim 11 wherein said substituted, unsymmetrical tertiary amine is one having the general formula:

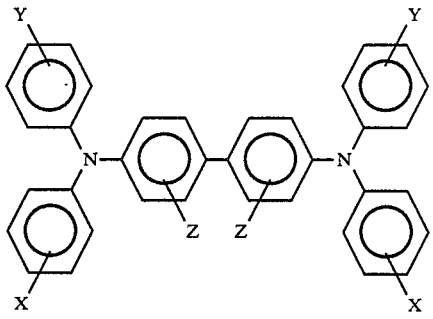

wherein X, Y and Z are selected from the group consisting of hydrogen, an alkyl group having from 1 to about 20 carbon atoms and chlorine and at least one of X, Y and Z is independently selected to be an alkyl group having from 1 to about 20 carbon atoms or chlorine.

13. An imaging method in accordance with claim 11 wherein said fracturable layer is a monolayer.

14. An imaging method comprising providing a migration imaging member comprising a substrate and an elecrically insulating softenable layer on said substrate, said softenable layer comprising a charge transport molecule and a fracturable layer of electrically photosensitive migration marking material located substantially at or near the surface of said softenable layer spaced from said substrate, said charge transport molecule being predominantly nonabsorbing in the spectral region at which said electrically photosensitive migration marking material photogenerates charge carriers, being capable of increasing charge injection from said electrically photosensitive migration marking material to said softenable layer and being dissolved or molecularly dispersed in said softenable layer, said softenable layer containing at least one material having a HOMO which lies from about 0.05 eV below the top of the valence band to above the top of said valence band of said electrically photosensitive migration marking material and a sufficient concentration of said charge transport molecule to allow electron injection into migration marking material exposed to activating radiation, electrostatically charging said member to a positive polarity, exposing said member to activating radiation in an imagewise pattern whereby said electrically photosensitive migration marking material struck by said activating radiation photogenerates charge carriers, decreasing the resistance to migration of migration marking marking material in said softenable layer sufficiently by exposure to solvent vapor to allow slight migration in depth of migration marking material towards said substrate in image configuration, and further decreasing the resistance to migration of marking material in said softenable layer sufficiently by heating to allow nonmigrated marking material to agglomerate.

15. An imaging method comprising providing a migration imaging member comprising a substrate and an electrically insulating softenable layer on said substrate, said softenable layer comprising a charge transport molecule and a fracturable layer of electrically photosensitive migration marking material located substantially at or near the surface of said softenable layer spaced from said substrate, said charge transport molecule being predominantly nonabsorbing in the spectral region at which said electrically photosensitive migration marking material photogenerates charge carriers, being capable of increasing charge injection from said electrically photosensitive migration marking material to said softenable layer and being dissolved or molecularly dispersed in said softenable layer, said softenable layer containing at least one material having a LUMO which lies from below the bottom of the conduction band to slightly above said bottom of said conduction band of said electrically photosensitive migration marking material and a sufficient concentration of said charge transport molecule to allow electron injection into said migration marking material exposed to activating radiation, electrostatically charging said member to a negative polarity, exposing said member to activating radiation in an imagewise pattern whereby said electrically photosensitive migration marking material stuck by said activating radiation photogenerates charge carriers, decreasing the resistance to migration of migration marking marking material in said softenable layer sufficiently by exposure to solvent vapor to allow slight migration in depth of migration marking material towards said substrate in image configuration, and further decreasing the resistance to migration of marking material in said softenable layer sufficiently by heating to allow nonmigrated marking material to agglomerate.

* * * * *